US007073318B2

(12) United States Patent
Tung et al.

(10) Patent No.: US 7,073,318 B2
(45) Date of Patent: Jul. 11, 2006

(54) APPARATUS AND METHOD FOR HEAT-SETTING CARPET YARNS WITH HOT ATMOSPHERIC AIR

(75) Inventors: Wae-Hai Tung, Marietta, GA (US); Ronnie Rittenhouse, Calhoun, GA (US)

(73) Assignee: Invista North America S.a.r.l., Wilmington, DE (US)

( * ) Notice: Subject to any disclaimer, the term of this patent is extended or adjusted under 35 U.S.C. 154(b) by 56 days.

(21) Appl. No.: 10/819,905

(22) Filed: Apr. 7, 2004

(65) Prior Publication Data

US 2005/0223689 A1 Oct. 13, 2005

(51) Int. Cl.
*D02G 1/20* (2006.01)

(52) U.S. Cl. ..... 57/284; 57/289

(58) Field of Classification Search ..... 57/284, 57/290, 221, 263; 28/221, 263
See application file for complete search history.

(56) References Cited

U.S. PATENT DOCUMENTS

| | | | | |
|---|---|---|---|---|
| 5,233,736 | A * | 8/1993 | Hill | 28/265 |
| 5,414,987 | A | 5/1995 | Knoff et al. | |
| 5,647,109 | A | 7/1997 | Steiner et al. | |
| 6,094,790 | A | 8/2000 | Weiss | |

* cited by examiner

*Primary Examiner*—Shaun R Hurley
(74) *Attorney, Agent, or Firm*—Charles E. Krukiel

(57) ABSTRACT

An apparatus and method for texture heat-setting bulk continuous filament (BCF) yarns in hot air heat-setting machines that includes a preheating device/step using a mixture of steam and atmospheric air to preheat a twisted BCF yarn bundle to develop crimp memory and provide cohesion to the twisted BCF yarn bundle. Yarn bundle cohesion during texture heat-setting helps to avoid frequent breaks at the winder of the hot air heat-setting machine. The addition of the preheating device/step significantly improves the ability of hot air heat-setting machines to maintain continuous operation during texture setting of BCF yarns and makes the hot air heat-setting method commercially viable for this application.

14 Claims, 3 Drawing Sheets

Steam
5
25
29
4
19a
19b
21
22
9
15
17
16
13
11
5
4

24
15
17
9
19a
22
19b 9
13
11

APPARATUS AND METHOD FOR HEAT-SETTING CARPET YARNS WITH HOT ATMOSPHERIC AIR

BACKGROUND OF THE INVENTION

The present invention relates to an apparatus and method for heat-setting yarn. More particularly, the present invention is an apparatus and method for heat-setting bulk continuous filament (BCF) yarns with hot atmospheric air.

Background art methods for making BCF yarns for carpets typically include the steps of twisting, heat-setting, tufting, dyeing and finishing. In particular, heat-setting of twisted yarn is an important step in converting BCF yarns to carpets. Heat-setting develops crimp and locks the twist memory in the BCF yarns. The development of crimp and twist memory have a significant impact on yarn bulk and newness retention of finished carpets.

Two types of heating-setting methods are used in continuous heat-setting machines of the background art. The first type uses pressurized steam (i.e., saturated or near saturated steam). The most common pressurized steam heat-setting machine in the background art is referred to as a Superba® machine and is made by Superba of Mulhouse, France or American Superba, Inc. of Charlotte, N.C. An exemplary Superba heat-setting machine is model number TVP-12-806, which operates with a maximum temperature of 154° C. and typically in the temperature range from 120° C. to 140° C.; and operates with a maximum pressure of 65.26 psi and typical in the pressure range from 22 to 37 psi.

The second type of heat-setting method uses hot atmospheric air. The most common hot atmospheric air heat-setting machine in the background art is referred to as a "Suessen" machine and is made by American Suessen, Inc. of Charlotte, N.C. An exemplary Suessen heat setting machine is the Horauf-Suessen, model number GKK-6R, which typically operates in the temperature range of 160° C. to 210° C.

The crystalline structure of heat-set yarns and the end use performance of the finished carpets produced from heat-set yarns primarily depend on the heat-setting method used in producing the yarn. In general, carpet yarns produced by hot atmospheric air heat-setting machines (e.g., Seussen) have higher bulk and better stain resistance than carpet yarns produced by pressurized steam heat-setting machines (e.g., Superba®).

In addition, there are two types of heat-set carpet yarns: texture set and straight set. Texture set twisted BCF yarns are more versatile in styling than texture set staple yarns. Moreover, it is much cheaper to convert BCF yarns into carpets than it is to convert straight yarns into carpets. The majority of the carpets in today's residential market use texture set yarns.

Texture set yarns are produced by feeding twisted yarn into a stuffer device before directing the stuffed and twisted yarn into a heat-setting machine. FIG. 1 shows a block diagram of a background art apparatus for producing texture set yarns. For heavy denier yarns (e.g., yarns with denier in the range from 2600 to 5000), at least two yarns 1 are fed to the input of a false twisting device 3. For average denier yarns (e.g., yarns with denier in range from 750 to 2600), three or more yarns 1 are fed to the input of a false twisting device 3, as shown in FIG. 1. A twisted yarn 9 emerges from the output of the false twisting device 3 and is fed to the input of a stuffer device 5. The stuffer device 5 crimps (i.e., bends and kinks) the twisted yarn 9. At the output of the stuffer device 5, the stuffed and twisted yarn 12 is piddled into a spaghetti-like pattern and fed onto a flat conveyor belt that carries the stuffed and twisted yarn 12 into a heat-setting machine 7. Heat-setting of the stuffed and twisted yarn 12 is performed in the heat-setting machine 7 by either pressurized steam or hot atmospheric air. The heat-set yarn 14 is then output from the heat-setting machine 7 and wound onto creels by a winder device (not shown).

The apparatus of FIG. 1 is applicable to texture set BCF carpet yarns that are heat-set by pressurized steam heat-setting machines. In addition, the block diagram of FIG. 1, without the stuffer device 3, is also applicable to straight set BCF carpet yarns. However, only texture set staple yarns currently can be produced by hot atmospheric air heat-setting machines. Due to the hairy nature of texture set staple yarns, the twisted yarn ends tend to stay together as a cohesive yarn bundle that can be easily separated and wound onto individual packages at the output of the heat-setting machine. Thus, heat-setting of texture set staple yarns with hot atmospheric air has proven to be an economical and reliable system for producing texture set staple carpet yarns.

However, the apparatus of FIG. 1 cannot be continuously operated for heat-setting texture set BCF yarns with hot atmospheric air. In contrast to the hairy surface characteristics of texture set staple yarns discussed above, texture set BCF yarns have smooth surface characteristics. The smooth surface characteristics of texture set BCF yarns provide no cohesion among the yarn ends of the stuffed and twisted BCF yarn bundle 12. In contrast to the texture set staple yarn bundle discussed above, the yarn ends of the stuffed and twisted BCF yarn bundle 12 tend to lie down separately on the conveyor belt feeding the stuffed and twisted BCF yarn bundle 12 into the heat-setting machine 7 shown in FIG. 1. This lack of cohesion in the stuffed and twisted BCF yarn bundle 12 leads to the problems with continuously processing BCF yarns discussed above. Due to the serious winding problems that occur when using hot atmospheric air in heat-setting of texture set BCF yarns, the apparatus of FIG. 1 is not applicable for heat-setting texture set BCF yarns with hot atmospheric air in a commercial application.

In addition, when hot atmospheric air is used in heat-setting machines, the yarn ends of the stuffed and twisted BCF yarn bundle tend to shrink. Any minor differences in the shrinkage among the yarn ends of the stuffed and twisted BCF yarn bundle can cause serious winding problems due to frequent yarn breaks. Thus, background art hot atmospheric air heat-setting apparatus and methods typically have not been used to continuously process stuffed and twisted BCF yarn in commercial applications.

Despite the problems discussed above, twisted BCF yarn carpets that are heat-set with hot atmospheric air have the significant advantages of providing higher bulk and better stain resistance than carpets that are heat-set with pressurized steam. Therefore, there is a need in the art to increase use of hot atmospheric air heat-setting machines on a commercial scale to heat-set twisted BCF yarns.

SUMMARY OF THE INVENTION

The present invention is an apparatus and method for heat-setting yarns with hot atmospheric air that can be used to texture set BCF yarns and achieve high process yields. In particular, the present invention preheats the twisted yarn bundle prior to the bundle being fed to a stuffer device and a hot atmospheric air heat-setting machine.

One embodiment of the present invention is an apparatus for heat-setting yarns, comprising: a false twisting device configured to produce a twisted yarn bundle from at least two yarns that are preferably texture set bulk continuous filament yarns; a heating device configured to preheat the twisted yarn bundle, preferably in hot atmospheric air provided from a mixture of steam and atmospheric air within a chamber of the heating device that is maintained in a temperature range from 25° C. to 38° C.; a stuffer device configured to crimp the preheated and twisted yarn bundle; and a heat-setting machine configured to heat-set the stuffed, preheated and twisted yarn bundle with hot atmospheric air, wherein the heating device contains at least one internal heating element, preferably a steam pipe, and operates at atmospheric pressure within the chamber.

Another embodiment of the present invention is a method for heat-setting yarns, comprising: false twisting at least two yarns to produce a twisted yarn bundle; preheating the twisted yarn bundle in hot atmospheric air in a heating device, preferably in a mixture of steam and hot atmospheric air that is maintained in a temperature range from 25° C. to 38° C.; pulling the preheated and twisted yarn bundle into a stuffer device configured to crimp the preheated and twisted yarn bundle; and heat-setting the stuffed, preheated and twisted yarn bundle in a heat-setting machine with hot atmospheric air.

The heating device provides a preheating function preferably using, but not limited to, steam and atmospheric air. More specifically, low-pressure steam (e.g., 2 pounds per square inch gauge (psig) to 8 psig) is introduced into the chamber of the heating device through which the twisted yarn bundle is passed. The steam and atmospheric air mixture produces hot atmospheric air that preheats the twisted BCF yarn to develop crimp and twist memory in the twisted BCF yarn bundle. With the addition of preheating, texture set BCF twisted yarn bundles can be produced continuously in a heat-setting machine using hot atmospheric air and excellent process yields are achieved. The addition of the preheating function makes using hot atmospheric air in the heat-setting machine producing texture set BCF yarns commercially viable.

DETAILED DESCRIPTION OF PREFERRED EMBODIMENTS

The apparatus and method for heat-setting yarns includes a heating device that makes commercial production of BCF twisted yarn bundles viable. While not wishing to be bound by any one theory, preheating the BCF twisted yarn bundle in the heating device reduces drag and tension on the BCF twisted yarn bundle. Drag and tension can seriously damage twist and crimp memory.

In addition, preheating with a low temperature steam and atmospheric air mixture at low pressure develops crimp and twist memory in the twisted yarn bundle. The crimp and twist memory provides the cohesion to the twisted yarn bundle that helps to avoid frequent breaking in the winding step after the heat-setting machine that occurs in background art hot air heat-set BCF twisted yarns. Therefore, the apparatus and method of the present invention makes continuous processing of the hot air heat-set BCF yarns in commercial production possible since frequent yarn breaking is avoided.

Figure 1:
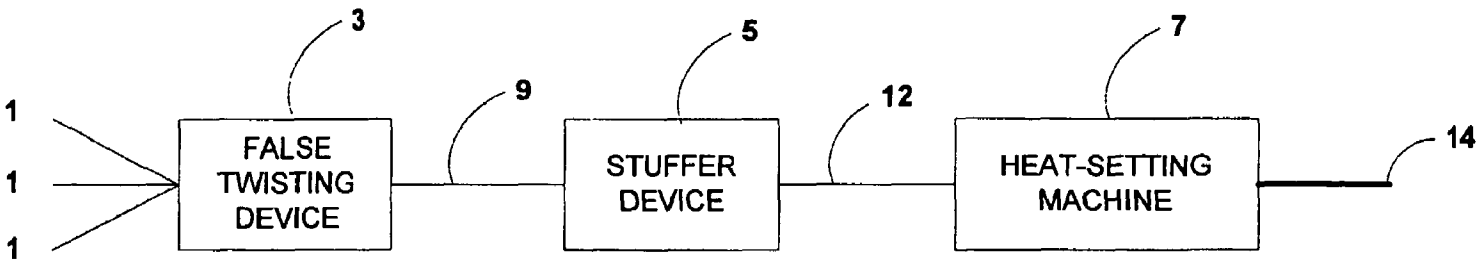
Fig. 1 (Background Art)
FIG. 1 is a block diagram schematically illustrating a background art heat-setting apparatus for texture set yarns.
Figure 2:
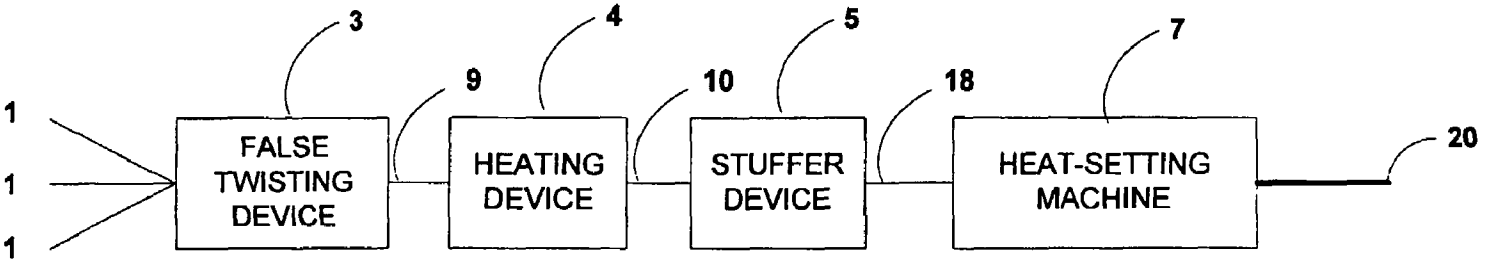
FIG. 2 is a block diagram schematically illustrating the heat-setting apparatus of the present invention that includes a heating device.

FIG. 2 shows a schematic block diagram of the apparatus of the present invention for heat-setting texture set BCF yarns. In contrast to the background art apparatus illustrated in FIG. 1, the inventive apparatus includes a heating device 4 after the false twisting device 3 and before the stuffing device 5. As discussed above, for heavy denier yarns, at least two yarns are fed into the false twisting device 3. In particular, FIG. 2 shows three yarns 1 that are fed into the false twisting device 3 that is configured to output a twisted yarn bundle 9. The heating device 4 preheats the twisted yarn bundle 9 that is output by the false twisting device 3. The heating device 4 preferably uses a steam and atmospheric air mixture at a temperature in a range from 25° C. to 38° C. and at a pressure in the range from 2 psig to 8 psig, as measured by a pressure gauge located at the point of entry of the steam pipes to the chamber of the heating device 4. The hot atmospheric air is produced by steam and atmospheric air mixture in the chamber of the heating device 4.

Next, as shown in FIG. 2, the preheated and twisted yarn bundle 10 at the output of the heating device 4 is fed into the stuffer device 5. A stuffed, preheated and twisted yarn bundle 18 is provided at the output of the stuffer device 5. The stuffed, preheated and twisted yarn bundle 18 is then fed into a heat-setting machine 7 and heat-set with hot atmospheric air. The hot atmospheric air of the heat-setting machine 7 is typically in the temperature range from 165° C. to 210° C. and preferably in the temperature range from 175° C. to 195° C. The heat-set yarn 20 is then output from the heat-setting machine 7 and wound onto creels by a winder device (not shown). The following paragraphs provide more detail of the individual elements that make up the block diagram of FIG. 2.

Typically, in a false twisting device 3 as shown in FIG. 2, a length of yarn is held at both one end and a center point and rotated at the center point about the yarn axis by suitable rotating means. As a result of this rotation of the yarn discussed above, twists in opposite directions will be inserted in the yarn both above and below the center point. However, the algebraic sum of twist in the length of the yarn is zero, and hence the name "false twisting device." Typical false twisting equipment can be obtained from Belmont Textile Company of Mount Holly, N.C. An exemplary false twisting device is the Belmont False twist, model number ADS 2498-3.

Figures 3, 4, 5:
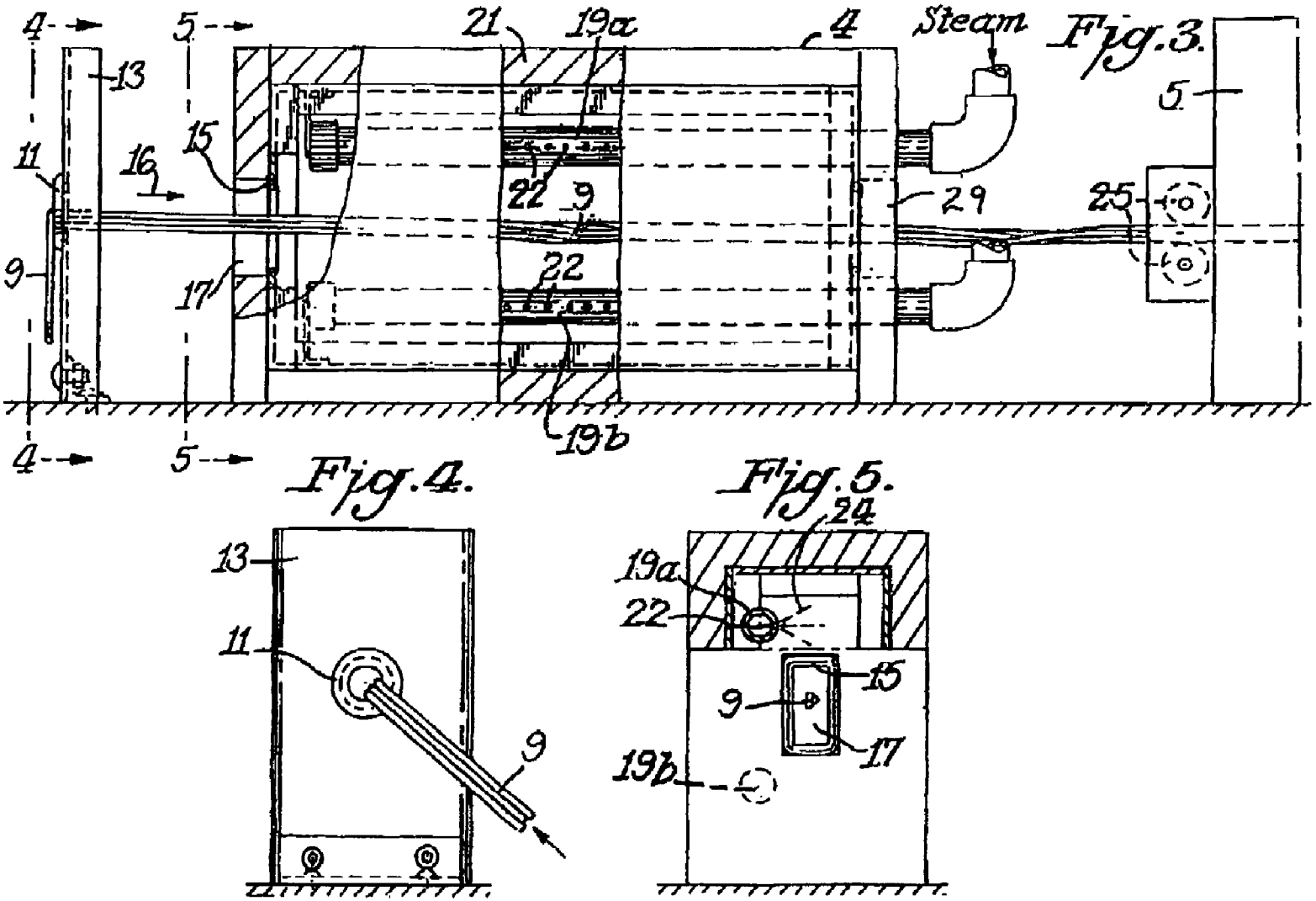
FIG. 3 is a side elevational view of the heating device.
FIG. 4 is an end elevational view of a twisted yarn guide plate for the heating device of FIG. 3.
FIG. 5 is an end elevational view of the heating device of FIG. 3.

Details of the structure of a preferred heating device 4 are shown in FIG. 3 to FIG. 5. Referring first to FIG. 3, the heating device 4 is shown in side elevation with portions broken away to show the internal elements of the chamber of the heating device 4. The twisted yarn bundle 9 is preheated with hot air produced by a mixture of steam and atmospheric air within the heating device 4 before being directed to the stuffer device 5 and heat-setting machine 7.

FIG. 4 shows an end elevational view of the guide plate 13 in the direction of line 4—4 of FIG. 3. As shown in FIG. 4, the twisted yarn bundle 9 is pulled through a protective ring 11 in a guide plate 13 that precedes the heating device 4. The protective ring 11 acts to shield the twisted yarn bundle 9 against the edges of the guide plate 13 and prevents cutting or fraying of the yarns 1 of the twisted yarn bundle 9. Preferably, the twisted yarn bundle 9 is pulled approximately parallel to the center line inside the heating device 4 in the direction of arrow 16 in FIG. 3.

As the twisted yarn bundle 9 is pulled through the chamber inside of the heating device 4, low pressure steam is fed through steam pipes 19*a*, 19*b*. The low pressure steam is in the range from 2 psig to 8 psig, as measured with a gauge at the point of entry of the steam pipes 19*a*, 19*b*, to the chamber of the heating device 4. The steam pipe 19*a*, 19*b* are located above and below the twisted yarn bundle 9 as the bundle is pulled through the chamber of the heating device 4. A plurality of holes 22 are drilled through the sides of the steam pipes 19*a*, 19*b* at locations preferably facing the center line of the heating device 4. The plurality of holes 22 in the steam pipes 19*a*, 19*b* deliver the low pressure steam into the volume space within the heating device 4 to fill all or nearly all of the space with steam that heats the atmospheric air inside the chamber of the heating device 4.

The steam and atmospheric air mixture produce hot atmospheric air in the temperature range from 25° C. to 38° C. that penetrates the twisted yarn bundle 9 as the bundle is pulled through the chamber of the heating device 4. The twisted yarn bundle 9 is pulled through the heating device 4 by the feed rolls 25 of the stuffer device 5. The speed at which the twisted yarn bundle 9 is pulled through the heating device 4 is typically in the range of 225 to 650 meters per minute. The draft tension range on the twisted yarn bundle 9 is less than 100 grams and the residence time of the twisted yarn bundle 9 in the heating device 4 is less than or equal to 0.1 seconds.

FIG. 5 shows an end elevational view of the heating device 4 in the direction of line 5—5 of FIG. 3. As shown in FIG. 5, a protective ring 15 is located at the entrance 17 to the heating device 4, and acts to shield the twisted yarn bundle 9 against the edges of the entrance 17 of the heating device 4 that could potentially cut, fray, or even break the yarns 1 of the twisted yarn bundle 9 as the bundle is pulled through the heating device 4. An identical protective ring (not shown) is similarly placed at the exit 29 of the heating device 4 that is located at the opposite end so that the twisted yarn bundle 9 is not damaged when exiting the heating device 4. In the preferred embodiment, the entrance 17 and exit 29 of the heating device 4 have dimensions of at least three (3) inches by one (1) inch. Therefore, the entrance 17 and exit 29 of the heating device 4 are much larger than the nominal diameter of the twisted yarn bundle 9 and allow atmospheric air to enter the chamber of the heating device 4.

As can be seen in FIG. 5, steam pipes 19*a*, 19*b* are offset from the center line of the heating device 4 and located above and below the twisted yarn bundle 9. Thus, the twisted yarn bundle 9 may pass through the heating device without contacting the steam pipes 19*a*, 19*b*. The configuration of the steam pipes 19*a*, 19*b*, along with the location of the plurality of holes 22 drilled in the steam pipes 19*a*, 19*b* allows the steam 24 to fill the inside of the heating device 4 through which the twisted yarn bundle 9 pulled for preheating. However, the configuration of the steam pipes 19*a*, 19*b* and holes 22 does not direct heated fluid onto the twisted yarn bundle 9. Preferably, the heated fluid is prevented from directly contacting the twisted yarn bundle 9 in order to avoid saturating the twisted yarn bundle 9. By avoiding saturation of the twisted yarn bundle 9, the problems of the background art, such as frequent breakage, may be avoided or at least substantially minimized As discussed above, due to the size of the entrance 17 and exit 29 of the chamber of the heating device 4, the pressure inside the chamber of the heating device 4 is at atmospheric pressure. Low pressure steam (i.e., with pressure in the range from 2 pounds per square inch gauge (psig) to 8 psig), as measured by a gauge at the point of entry of the steam pipes 19*a*, 19*b* to the heating device 4, is fed into the steam pipes 19*a*, 19*b*. The heating device 4 is preferably, but not limited to, a steam device with steam input at a pressure from 2 psig (138 kilopascals) to 8 psig (552 kilopascals), as measured by a gauge in the steam pipe at the entrance to the chamber. Alternatively, the steam is at a pressure from 4 psig (276 kilopascals) to 6 psig (414 kilopascals).

The heating device 4 preferably is surrounded by an insulating jacket 21 that helps to maintain a consistent temperature inside the heating device 4. The temperature of the low pressure steam inside the heating device 4 preferably in the temperature range from 25° C. to 38° C. As a result, the temperature of the twisted yarn bundle 9 inside the heating device 4 is also in the range from 25° C. to 38° C. The steam and atmospheric air mixture, where the steam is at least at 100° C., provided inside the chamber of the heating device 4 produces the operating temperature range from 25° C. to 38° C. This temperature range provides sufficient preheating of the twisted yarn bundle 9 but avoids damage to the crimp and twist memory that can occur at higher operating temperatures.

The stuffer device 5, as shown in FIG. 2, is located after the heating device 4. The stuffer device 5 crimps (i.e., kinks and bends) the preheated and twisted yarn bundle 10. Typical stuffer device equipment is made by American Linc design of Gastonia, N.C. In addition, an exemplary stuffer device is disclosed in U.S. Pat. No. 5,647,109.

The heat setting machine 7, shown schematically in FIG. 2, is preferably, but not limited to, a Suessen heat-setting machine, available from American Suessen, Inc. of Charlotte, N.C. Moreover, the heat-setting machine 7 is preferably, but not limited to, an apparatus that uses hot atmospheric air with a temperature in the range of from 165° C. to 210° C. Alternatively, the hot atmospheric air temperature inside the heat-setting machine can be in the temperature range from 175° C. to 190° C. The belt density was 150 gram/meter, and the crimped, preheated and twisted yarn bundle is fed into the heat-setting machine at a rate of 8 feet/minute. The residence time of the crimped, preheated and twisted yarn bundle in the hot atmospheric air heat-setting machine was 60 seconds.

Figure 6:
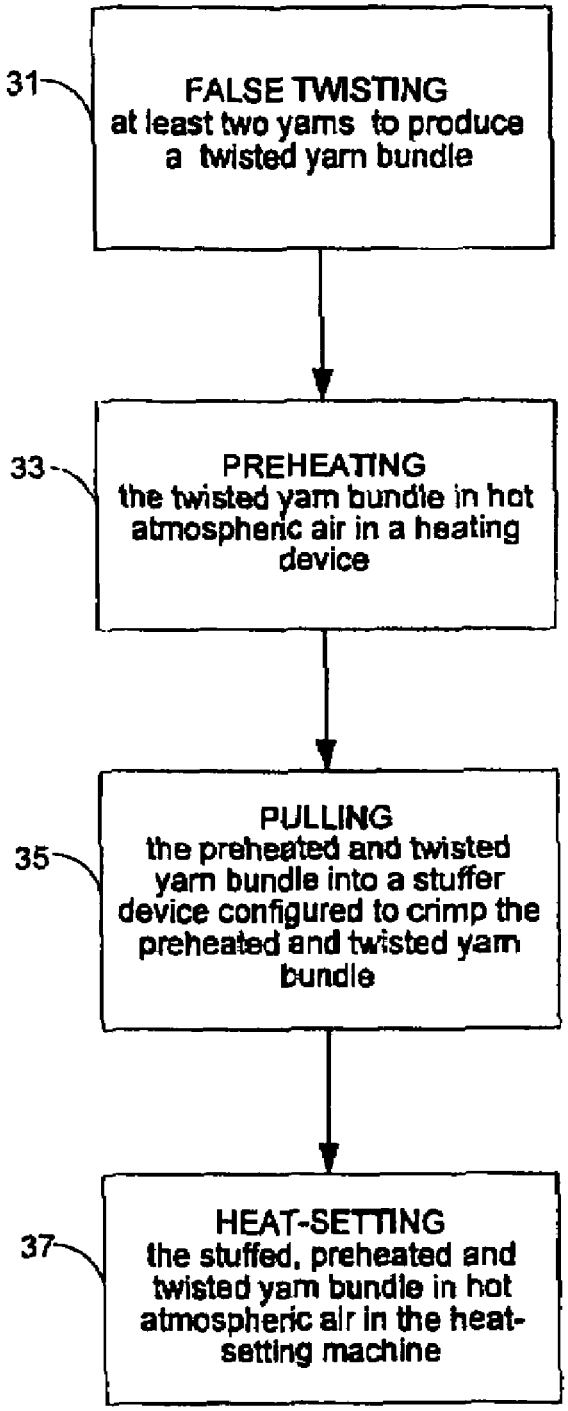
FIG. 6 is a flow diagram of the method of the present invention.

FIG. 6 shows an exemplary flow diagram of the preferred heat-setting method of the present invention. In step 31 of FIG. 6, at least two yarns are fed into a false twisting device that outputs a twisted yarn bundle. At step 33 of FIG. 6, the twisted yarn bundle is preheated in a heating device, where such preheating preferably is carried out in hot atmospheric air provided by a mixture of steam and atmospheric air. The temperature of the twisted yarn bundle is in the range from 25° C. to 38° C. during preheating. The preheated and twisted yarn bundle is then pulled through the heating device and fed into a stuffer device in step 35. While in the stuffer device, the preheated and twisted yarn bundle is crimped (i.e., bent and kinked). Finally, in step 37, the stuffed, preheated and twisted yarn is heat-set in a heat-setting machine.

The apparatus and method of the present invention facilitate heat-set processing of both texture set staple yarns and texture set BCF yarns. That is, the present invention is very robust and applicable to both staple and BCF yarns. Representative yarns that may be processed in the apparatus and in accordance with the method of the present invention include, but are not limited to, nylon 6, nylon 66, Trimethylene Terphthalate, Ethylene Terephthalate and polypropylene.

Testing Methods

The present invention is further illustrated by the following examples, but these examples should not be construed as limiting the scope of the invention.

Wear tests which closely correlate to floor trafficking were conducted in a Vetterman drum test apparatus, Type KSG manufactured by Schoenberg & Co. Baumberg, Fed. Rep of Germany, according to ISO (International Standards Organization) Document TC38/12/WG 6 N48. As specified, the drum was lined with carpet samples into which a 16 pound steel ball having fourteen (14) rubber buffers which rolls randomly inside the rotating drum were placed. A circular brush within the drum was in light contact with the carpet surface and picks up loose pile fibers which are continuously removed by suction. After 5,000 cycles, the samples were removed and inspected to evaluate texture retention. Texture retention was reported on a scale of 1 to 5 with a rating of 5 corresponding to a lightly worn sample, 3 to a moderately worn sample, and 2.5 to the turning point from acceptable to unacceptable wear. A rating of 2 corresponds to clearly unacceptable wear, and 1 corresponds to an extremely matted sample.

EXAMPLE 1 (COMPARATIVE)

In this comparative example, approximately 60 pounds of 1120 denier, 61 filaments nylon 66 BCF yarn were converted into 4.75 twists per inch twisted yarn. Three ends of yarns were texture set together on a Suessen hot air heat-setting machine. The ends were fed through a false twisting device, a stuffer device and heat-set in the Suessen hot air heat-setting machine. The belt density was 150 gram/meter and the residence time in the hot air heat-setting machine was 60 seconds. The hot air temperature was set at 190° C. Eleven winding breaks were observed during 3 hours of operation. The test yarn collected was converted into 5/32 gauge, 18/32 inch pile height, 25 oz/square yard cut pile carpets. This carpet had an inadequate textured look and the method was not acceptable for commercial operation.

EXAMPLE 2

Approximately 60 pounds of 1120 denier, 61 filaments nylon 66 BCF yarn was converted into 4.75 twists per inch twisted yarn. Three ends of the yarns were texture set together on the hot air heat-setting machine of this invention. The ends of the yarns were fed through a false twisting device, a heating device, a stuffer device and into a hot air heat-setting machine. The steam pressure inside the heating device was atmospheric. The belt density was 150 gram/meter and the residence time in the hot air heat-setting machine was 60 seconds. The hot air temperature in the heat-setting machine was set at 190° C. No process breaks were observed during three hours of operation. The test yarn was converted into 25 oz/square yard carpet similar to Example 1. The finished carpet had much better aesthetics in terms of tip definition and texture look than Example 1.

EXAMPLE 3

Approximately 50 pounds of 1120 denier, 61 filaments nylon 66 BCF yarn was converted into 4.75 twist per inch and heat-set on a hot air heat-setting machine as described in Example 2. However, the hot air temperature in the chamber of the heat-setting machine was set at 183° C. instead of 190° C., as in Example 2. No process breaks were observed during the entire test. The test yarn was converted into 25 oz/square yard carpet and had the aesthetic characteristics as described in Example 2.

EXAMPLE 4

Approximately 50 pounds of 1120 denier 61 filament nylon 66 BCF yarn was processed similarly to Example 2, except that the hot air temperature in the heat-setting chamber was set at 176° C. instead of 190° C., as in Example 2. No process breaks were observed. The test yarn was converted into 25 oz/square yard carpet and had the aesthetic characteristics as described in Example 2.

EXAMPLE 5

Approximately 50 pounds of 1120 denier 61 filament nylon 66 BCF yarn was processed similarly to Example 2, except that the hot air temperature in the heat-setting chamber was set at 170° C. instead of 190° C., as in Example 2. No process breaks were observed. The test yarn was converted into 25 oz/square yard carpet and had the aesthetic characteristics as described in Example 2.

The carpet samples from Examples 1to 5 were tested for texture retention in a Vetterman drum for 5,000 cycles. The texture retention rating system values are in the range from 1-to-5, with 5 being considered as "like new." The performance ratings are summarized in Table 1.

TABLE 1

| Example | Steam before stuffer device | Texture retention rating |
|---|---|---|
| 1 | no | 3.0 |
| 2 | yes | 3.5 |
| 3 | yes | 3.5 |
| 4 | yes | 3.5 |
| 5 | yes | 3.5 |

The test results of Table 1 indicate texture retention ratings of 3.5, which is commercially acceptable. Moreover, the present invention also makes it possible to reduce energy costs associated with a hot air texture set method by reducing the hot air heat-setting machine temperature from above 200° C. to temperatures of 170° C. to 190° C., as shown in Examples 2 to 5. Thus, the description of the present invention and test results demonstrate that an apparatus and method for hot atmospheric air heat-setting of BCF yarns is commercially viable.

The foregoing description of preferred embodiments of the present invention provides illustration and description, but is not intended to be exhaustive or to limit the invention to the precise form disclosed. Modifications and variations are possible in light of the above teachings or may be acquired from practice of the invention. The scope of the invention is defined by the claims and their equivalents.

We claim:

1. An apparatus for heat-setting yarns, comprising:

a false twisting device configured to produce a twisted yarn bundle from two or more yarns;

a heating device having at least one internal heating element configured to preheat the twisted yarn bundle;

a stuffer device configured to crimp the preheated and twisted yarn bundle; and a heat-setting machine configured to heat-set the stuffed, preheated and twisted yarn bundle with hot atmospheric air, wherein the heating device defines a chamber into which steam is introduced at a pressure from 2 psig to 8 psig.

2. The apparatus according to claim 1, wherein the steam is introduced into the chamber at a pressure from 4 psig to 6 psig.

3. The apparatus according to claim 1, wherein steam is introduced into the chamber through the at least one steam pipe and is expelled from the at least one steam pipe and into the chamber through a plurality of holes in the at least one steam pipe, wherein steam expelled from the at least one steam pipe does not directly impinge on the twisted yarn bundle as the twisted yarn bundle is passed through the chamber.

4. The apparatus according to claim 1, wherein the chamber defines an internal temperature that is maintained in the range from 25° C. to 38° C.

5. The apparatus according to claim 1, wherein the heat-setting machine defines a chamber into which hot atmospheric air at a temperature between 165° C. and 210° C. is introduced.

6. The apparatus according to claim 5, wherein the hot atmospheric air is introduced into the chamber of the heat-setting machine at a temperature between 175° C. and 190° C.

7. A method for heat-setting yarns, comprising:

false twisting at least two yarns to produce a false twisted yarn bundle;

preheating the false twisted yarn bundle in a chamber by expelling steam into the chamber through a plurality of holes in at least one steam pipe positioned therein such that the expelled steam does not directly impinge on the false twisted yarn bundle passing through the chamber;

pulling the preheated and twisted yarn bundle into a stuffer device configured to crimp the preheated and twisted yarn bundle; and heat-setting the stuffed, preheated and twisted yarn bundle in a heat-setting machine with hot atmosphene air.

8. The method according to claim 7, wherein the at least two yarns are bulked continuous filament yarns.

9. The method according to claim 7, wherein the at least two yarns are texture set bulked continuous filament yarns.

10. The method according to claim 7, wherein the temperature inside the chamber is maintained in the range from 25° C. to 38° C.

11. The method according to claim 7, wherein the steam is introduced into the chamber at a pressure from 2 psig to 8 psig.

12. The method according to claim 7, wherein the steam is introduced into the chamber at a pressure from 4 psig to 6 psig.

13. The method according to claim 7, wherein the hot atmospheric air temperature in the heat-setting machine is between 165° C. and 210° C.

14. The method according to claim 7, wherein the hot atmospheric air temperature in the heat-setting machine is between 175° C. and 190° C.

* * * * *